United States Patent [19]

Novak

[11] 4,111,509

[45] Sep. 5, 1978

[54] ELECTRIC PLUG LOCK MEANS

[76] Inventor: John Novak, 1533 W. 52nd Pl., Merrillville, Ind. 46410

[21] Appl. No.: 837,696

[22] Filed: Sep. 29, 1977

[51] Int. Cl.[2] ..... H01R 3/06

[52] U.S. Cl. ..... 339/14 P; 339/195 M; 339/252 R

[58] Field of Search ..... 339/14 P, 195 M, 196 A, 339/196 M, 252 R, 253 R

[56] References Cited

U.S. PATENT DOCUMENTS

| | | | |
|---|---|---|---|
| 3,044,035 | 7/1962 | Adams, Jr. | 339/195 M X |
| 3,358,265 | 12/1967 | Robards | 339/195 M |

*Primary Examiner*—Roy Lake
*Assistant Examiner*—DeWalden W. Jones
*Attorney, Agent, or Firm*—Walter Leuca

[57] ABSTRACT

A plug for an electrical receptacle outlet having an improved ground prong. The ground prong is supported in the plug body for axial shifting. The end of the prong extending through the plug body is threaded to engage a turn knob and the other end of the ground prong extending from the plug body for insertion in the receptacle is adapted to carry spring filaments which are supported to radially arch by the axial movement of the ground prong in response to the rotation of the knob and thereby secure the plug connected to the receptacle.

5 Claims, 6 Drawing Figures

ELECTRIC PLUG LOCK MEANS

BACKGROUND OF THE INVENTION

1. Field of the Invention

This invention relates to electrical plugs and more particularly to electrical plugs provided with a ground post.

2. Description of the Prior Art

The problem of the prior art that this invention is directed to is the easy removal of the plug from the electrical receptacle outlet especially when the plug is the distal end of an electrical cord servicing an appliance which is not stationary but manually handled in the course of the use of an appliance such as a drill or a circular saw. For ease in making the connection between the plug and the receptacle the prongs of the plug must be easily inserted into the receptacle and also readily removable since these operations are done by hand. However, while the plug is mated to the receptacle and the appliance is in use, it is desired that the plug be not easily removable from the receptacle to prevent accidental removal thereof.

SUMMARY OF THE INVENTION

Accordingly, this invention provides a ground post which is made to expand in the receptacle by simply turning a knob thereby wedging the expanded ground post in the ground slot of the receptacle in order to secure the plug against the receptacle. When it is desired to remove the plug from the receptacle, the knob is counterrotated causing the ground post to diminish in lateral size thereby loosening the wedge connection between the plug and receptacle.

Other objects and advantages of my invention will become more apparent after a careful study of the following detailed description taken together with the accompanying drawings which illustrate a preferred embodiment of my invention.

DESCRIPTION OF THE PREFERRED EMBODIMENT

Figure 2:
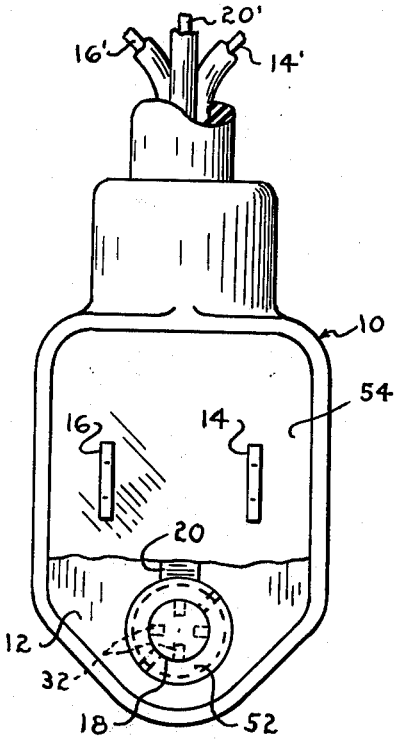
FIG. 2 is a front view of the plug as it would appear by viewing FIG. 1 from left to right.
Figure 1:
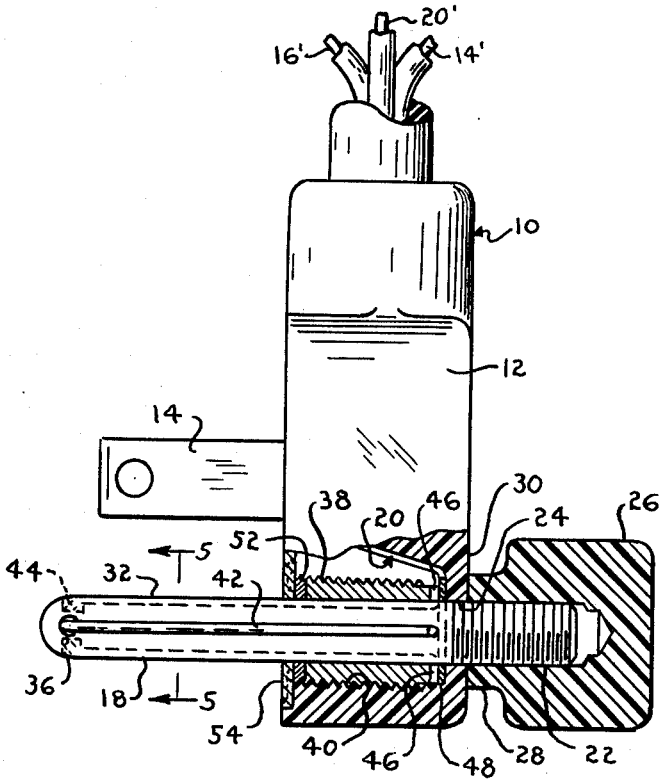
FIG. 1 is a side elevation of the electrical plug embodying this invention shown partly in section.
Figure 3:
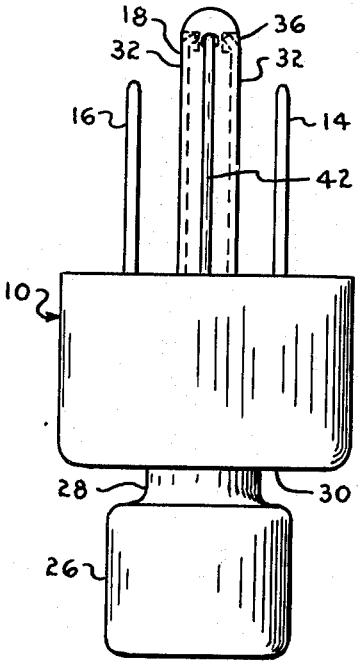
FIG. 3 is a bottom view of the plug of this invention.
Figure 4:
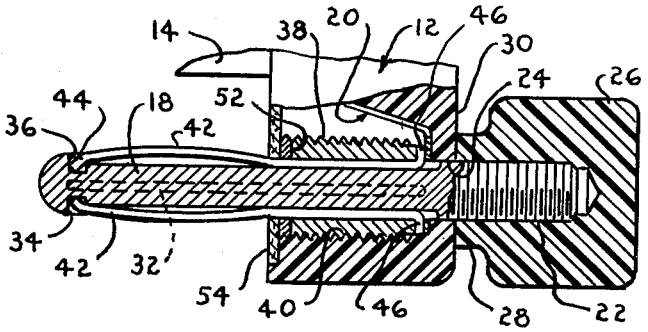
FIG. 4 is a side diametral section of the ground post portion of the plug.
Figure 5:
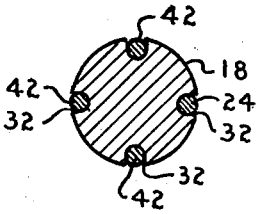
FIG. 5 is a cross section of the ground plug taken along line 5—5 of FIG. 1.
Figure 6:
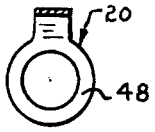
FIG. 6 is a detail front view of the ground wire connector.

Referring now more particularly to the drawings, the electrical plug of this invention is designated generally by the numeral 10. It comprises a body 12 having a pair of contact blades 14, 16 extended in spaced, parallel relation. One end of blades 14, 16 are anchored to body 12 to which are connected electric wires 14', 16' in the conventional fashion. Vertically spaced from blades 14, 16 and generally spaced midway therebetween extends a ground post 18 anchored to body 12. The anchored end of ground post 18 is connected to a third wire 20' of the plug which is the conventional arrangement. The novel feature of this invention is the provision of ground post 18 with threaded end 22 extending through hole 24 provided in body 12 of plug 10. Threaded end 22 is threadedly engaged by a turn knob 26, end 28 thereof abutts against the back side 30 of the body of the plug. It is preferred to provide longitudinal grooves 32 in the portion of post 18 which extends forward of the plug equally spaced circumferentially therearound and which terminates in a circumferential groove 34 adjacent the distal end of the post to thereby provide a stop 36 in advance of longitudinal grooves 32. Ground post 18 is securely supported in body 12 of plug 10 by threaded bushing 38 which surrounds the shank of the post and threadedly engages threaded recess 40 in body 12 of the plug. Provided in longitudinal grooves 32 of post 18 are spring bands or filaments 42 having their forward ends 44 inwardly bent to enter circumferential groove 34 at the forward end of the post and made to abutt against stop 36 of post 18. The other end of spring filament 42 is radially angled as at 46 and fitted between ring portion 48 of ground wire connector 20 and the end of bushing 38 when bushing 38 is threadedly tightened in place. A spacer 52 is shown provided between the back end of bushing 38 and cover plate 54 of plug 10. This novel structure serves to anchor ground post 18 in body 12 of plug 10, and to retain spring filaments 42 in grooves 32 provided in ground post 18. It also provides for making firm contact with ground wire connector 20 to which is connected ground wire 20' and prevents the rotation of post 18 when turn knob 26 is rotated on threaded end 22 of the post to axially move the post which causes the radial expansion of spring filaments 42 at the forward end of the post to effect the wedge tightening of post 18 in a receptacle. Thus by turning knob 26, ground post 18 is caused to axially shift and spring filaments 42 being anchored against body 12 will radially arch to wedge against the circumferential surface of the receptacle hole in which ground post 18 fits and thereby secure plug 10 in its receptacle.

I claim:

1. In an electrical plug wherein said plug comprises a body having electric contact blade members extending therefrom, a ground post extending from said body, said ground post and said electrical contact blades adapted for insertion in an electric receptacle, and said plug body having electric conducting wires so that the ends of said wires connect to said electric contact blades and said ground post, the improvement comprising: said plug body having a hole therethrough, a portion thereof being enlarged; said ground post extending through said hole, said ground post being formed with a longitudinal groove; a filament member in said groove, said filament member having one end upended to radially extend out of the groove and the other end angled to seat in the groove at the distal end of said post; a bushing member seated in the enlarged portion of said hole in said plug body circumferentially supporting said post in said hole; means between said bushing member and said plug body for contacting the upended end of said filament member and the ground wire, said bushing member abutting the upended end of said filament member against said means connecting said ground wires; and a knob member connected to the end of said ground post extending through said plug body for longitudinally shifting said ground post to radially flex said filament member out of said groove.

2. The plug of claim 1 wherein said enlarged portion of said hole in said plug body is further characterized as being threaded and said bushing member being threadedly seated therein circumferentially supporting said post in said hole and threadedly wedging said upended end of said filament member against said means connecting said ground wire.

3. The plug of claim 1 wherein said ground post is further characterized as being threaded at the end thereof extending through said plug body, as having a longitudinal groove in the shaft thereof extending to adjacent the other end thereof, and having a circumferential groove in said other end thereof at the distal end of said longitudinal groove.

4. The plug of claim 3 wherein said knob member is further characterized as having a threaded hole for threadedly engaging the threaded end of said ground post extending through said plug body and in abuttment with said plug body to longitudinally shift said ground post against the flexing bias of said filament.

5. In an electrical plug wherein said plug comprises a body having electric contact blade members extending therefrom, a ground post extending from said body, said ground post and said electric contact blades adapted for insertion in an electric receptacle, and said plug body having electric conducting wires so that the ends of said wires connect to said electric contact blades and said ground post, the improvement comprising; said plug body having a hole therethrough, a portion of said hole being threaded; said ground post having a threaded end extending through said hole, said ground post having a longitudinal groove in the shank portion thereof to adjacent the other end thereof and a circumferential groove at the distal part of said other end thereof; a filament member in said groove, said filament member having one end upended to radially extend out of said groove and the other end angled to seat in the circumferential groove at the distal end of said post; means in said hole for contacting said upended end of said filament member and said ground wire; a bushing member threadedly seated in the threaded portion of said hole in said plug body circumferentially supporting said post in said hole, and abutting the upended end of said filament member against said means connecting said ground wire; and a knob member having a threaded hole for threadedly engaging the threaded end of said ground post extending through said hole in said plug body, said knob being rotatable against said plug body to longitudinally shift said ground post against the flexing bias of said filament member.

* * * * *